US006732452B2

(12) United States Patent
Lin et al.

(10) Patent No.: US 6,732,452 B2
(45) Date of Patent: May 11, 2004

(54) APPARATUS AND PROCESS FOR THROUGHAIR DRYING OF A PAPER WEB

(75) Inventors: Philip S. Lin, Oshkosh, WI (US); Ronald F. Gropp, St. Catharines (CA); Kevin B. Sartain, Broken Arrow, OK (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/027,910

(22) Filed: Dec. 21, 2001

(65) Prior Publication Data

US 2003/0115773 A1 Jun. 26, 2003

(51) Int. Cl.[7] ..... F26B 3/00
(52) U.S. Cl. ..... 34/444; 34/446; 34/422
(58) Field of Search ..... 34/419–422, 444–446, 34/448, 452

(56) References Cited

U.S. PATENT DOCUMENTS

| | | | |
|---|---|---|---|
| 3,432,936 | A | 3/1969 | Cole et al. |
| 3,686,903 | A | 8/1972 | Fleissner |
| 4,157,938 | A | 6/1979 | Clemens et al. |
| 4,192,711 | A | 3/1980 | Tapio et al. |
| 4,242,808 | A | 1/1981 | Luthi |
| 4,622,758 | A | 11/1986 | Lehtinen et al. |
| 4,780,967 | A | 11/1988 | Mučic |
| 4,932,424 | A | 6/1990 | Liebe et al. |
| 4,974,338 | A | 12/1990 | Banford et al. |
| 4,977,687 | A | 12/1990 | Boissevain |
| 5,042,373 | A | 8/1991 | Fenzau et al. |
| 5,105,558 | A | 4/1992 | Curry |
| 5,210,958 | A | 5/1993 | Bond et al. |
| 5,282,323 | A | 2/1994 | Winheim |
| 5,553,392 | A | 9/1996 | Hanaya |
| 5,588,223 | A | 12/1996 | Marshall |
| 5,619,806 | A | 4/1997 | Warren |
| 5,647,141 | A | 7/1997 | Hanaya |
| 5,653,041 | A | 8/1997 | Ilmarinen et al. |
| 5,845,415 | A | 12/1998 | Sundqvist |
| 5,865,955 | A | 2/1999 | Ilvespääet et al. |
| 5,974,691 | A | 11/1999 | Marchal et al. |

OTHER PUBLICATIONS

US 6,134,809, 10/2000, Stipp (withdrawn)
PCT Search Report dated Dec. 12, 2002.

*Primary Examiner*—Henry Bennett
*Assistant Examiner*—Camtu Nguyen
(74) *Attorney, Agent, or Firm*—Dority & Manning, P.A.

(57) ABSTRACT

A paper web drying apparatus and process is provided in which the heated air drying medium is replaced with between 10 percent to 100 percent of live steam. The addition of a steam component to the drying medium provides for a higher drying temperature to be supplied to the wet moving web. The introduction of live pressurized steam contributes to the load of force of the drying medium, thereby decreasing the energy requirements of blower motors. The introduction of pressurized live steam also lowers the free atmospheric oxygen content of the drying medium which reduces the burning or scorch hazard associated with high temperature drying of a cellulose web.

15 Claims, 5 Drawing Sheets

APPARATUS AND PROCESS FOR THROUGHAIR DRYING OF A PAPER WEB

BACKGROUND OF THE INVENTION

In the manufacture of tissue products such as bath tissue, a wide variety of product characteristics must be given attention in order to provide a final product with the appropriate blend of attributes suitable for the product's intended purposes. Improving the softness of a tissue product has always been a major objective for premium products. The major components of softness include stiffness and bulk (density), with lower stiffness and higher bulk (lower density) generally improving perceived softness.

One traditional approach to producing tissue products has involved compression of a wet laid web between an absorbent felt and the surface of a rotating heated cylinder such as a Yankee dryer. The dried web is thereafter dislodged from the Yankee dryer in a creping process in which a blade is used to partially de-bond the dried web by breaking many of the bonds previously formed during the wet pressing stages of the process. Creping generally improves the softness of the web, albeit at the expense of a significant loss in strength.

More recently, throughdrying has become a more prevalent means of drying tissue webs. Throughdrying provides a relatively non-compressive method of removing water from the web by passing hot, dry air through the web until it is dry. More specifically, a wet-laid web is transferred from a forming fabric to a coarse, highly permeable throughdrying fabric and retained on the throughdrying fabric through passage of a "through air dryer", (hereinafter TAD). The resulting dried web is softer and bulkier than a wet-pressed uncreped dried sheet because fewer paper-making bonds are formed and because the web is less dense.

Although throughdried tissue products exhibit good bulk and softness properties, throughdrying tissue machines are expensive to build and operate. Accordingly, there is a need for improvements for a throughdrying apparatus and process which produces high quality tissue products.

SUMMARY OF THE INVENTION

It has now been discovered that in the manufacture of uncreped, throughdried tissue sheets, improved efficiencies and a higher quality end tissue product may be obtained by the addition of high temperature steam to the drying medium. In so doing, tissue sheets can be made which have improved absorbance and softness values. Further, the addition of high temperature steam to the drying medium allows the throughair drying process to be carried out more economically and under conditions which eliminate the scorching or burning of the drying web.

Hence, in one aspect, the invention resides in a method for making a throughdried tissue comprising depositing an aqueous suspension of papermaking fibers onto a forming fabric to form a wet web, transferring the wet web to a throughdrying fabric, and throughdrying the web to form a tissue sheet. The use of a drying medium having a high steam content of between 10 percent to 100 percent by volume of the medium allows the use of higher drying temperatures compared to a conventional heated air drying medium. The steam enhanced drying medium converts the free moisture within the fabric web to a water vapor and which is removed by the passage of the drying medium.

Hence, in another aspect, the invention resides in the foregoing method wherein the tissue sheet is dried using a drying medium in which high temperature steam is added to increase the temperature of the drying medium above the burning temperature of paper. The addition of live steam reduces the concentration of oxygen and allows a higher drying temperature to be achieved without scorch or burning of the paper web.

In a further aspect, the invention resides in supplying a drying medium to a fabric web in which the drying medium is substantially free of oxygen. As used herein, the term "substantially free" is defined as having a free oxygen content of a sufficiently low concentration such that burning or scorching of a paper web is prevented when the drying medium temperature is above the traditional scorch or burning temperature for a heated air TAD process. Likewise, the term "reduced oxygen drying medium" is defined as a heated air medium in which a percentage of the drying medium comprises live steam. As such, the oxygen gas concentration within the drying medium is reduced compared to a heated drying medium without the addition of live steam. Typically, heated air will have an $O_2$ percentage of about 21%.

The use of a reduced concentration oxygen gas or substantially oxygen-free drying medium allows a drying temperature higher than the scorch or burn temperature of a paper web to be used. The scorch temperature of a paper web may vary depending upon the thickness and quality of the referenced web. However, the scorch temperature for any particular paper web may be readily determined and such temperatures are, in fact, known values within the industry for various types of commercially produced webs.

The use of an elevated throughair drying temperature brings about an additional improvement in the water absorbency and softness of the tissue fabric by the provision of a supply-side drying temperature above the glass transition point of paper fiber. The elevated temperatures allow the paper fiber to mold and permanently set the pulp fibers in an altered and desired shape.

In yet a further aspect, the invention resides in the foregoing method wherein the introduction of pressurized steam into the drying medium increases the velocity of the drying medium. This, in turn, lowers the energy demand on electric blowers and fans proportional to the motive energy provided by the introduced steam.

In yet a further aspect, the invention resides in a papermaking process in which the drying medium, upon leaving the throughdried web, has a portion of the resulting exhaust stream discharged along annular gaps defined between a throughair dryer hood and the associated paper web and drum. The discharge of the used drying medium forms a curtain seal along the annular gap seals and dryer web entry slot, thereby preventing cooler, oxygen-rich ambient air from infiltrating into the drying medium loop. Simultaneously, the exhaust curtain seals allow the discharge of a portion of the used drying medium so as to maintain an equilibrium of the drying medium circulation loop.

In yet another aspect, the invention resides in a method of making a tissue sheet wherein the throughair drying step is carried out by a drying medium comprising substantially about 100 percent (by volume) live steam. The use of substantially about 100 percent live steam will greatly reduce and may eliminate the need for electric motors used to circulate the drying medium. As a result, increased efficiencies can be obtained by the cost savings reflected in the use of pressurized steam as opposed to electric blowers to move the drying medium.

These and other aspects of the invention will be described in greater detail in reference to the figures and specification set forth below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings.

DETAILED DESCRIPTION OF THE INVENTION

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

In describing the various figures herein, the same reference numbers are used throughout to describe the same apparatus or process pathway. To avoid redundancy, detailed descriptions of much of the apparatus once described in relation to a figure is not repeated in the descriptions of subsequent figures, although such apparatus or process is labeled with the same reference numbers.

Figure 1:
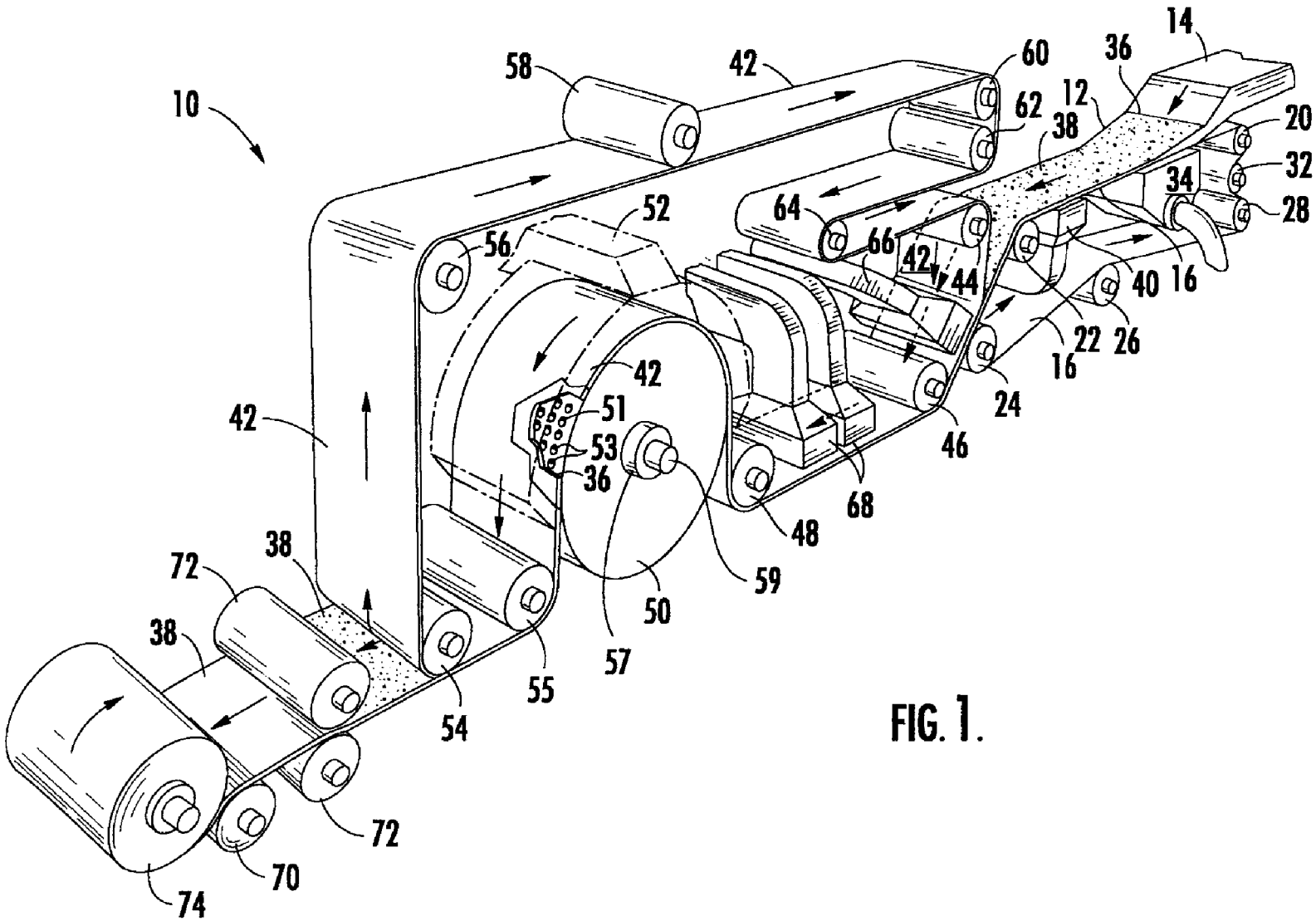
FIG. 1 is a perspective view of a process line for producing a throughdried tissue product in accordance with this invention.

Referring first to FIG. 1, there is illustrated a process line 10 suitable for carrying out the preferred process of the present invention. The description given in reference to FIG. 1 is illustrative of but one process and apparatus for making a tissue product in which a throughair dryer is utilized. It is understood and appreciated by one having ordinary skill in the art that a variety of throughair drying apparatuses and paper-making processes may be used in conjunction with the present invention.

The process line begins with a papermaking furnish 12 comprising a mixture of secondary cellulosic fiber, water, and a chemical debonder which is deposited from a conventional headbox (not shown) through a nozzle 14 on top of a foraminous wire forming belt 16 as shown in FIG. 1. The forming belt 16 travels around a path defined by a series of guide rollers. The forming belt 16 travels from an upper guide roller 20, positioned below and proximate to the headbox nozzle 14, horizontally and away from the headbox nozzle to another upper guide roller 22, passes through the upper guide roller 22 and diagonally and downwardly to a lower guide roller 24, passes under the lower guide roller 24 and diagonally and upwardly toward the nozzle 14 to a lower guide roller 26, passes over lower guide roller 26 and diagonally and downwardly to lower guide roller 28, passes under lower guide roller 28 and turns upwardly and slightly inwardly to a guide roller 32, passes behind the guide roller 32 and upwardly and outwardly returns to upper guide roller 20.

A vacuum forming box 34 positioned beneath the forming belt 16 proximate to the opening 36 of the headbox nozzle 14 immediately extracts water from the moist fibrous web 38 deposited on top of the forming belt by the headbox nozzle. The partially dewatered fibrous web is carried by the forming belt 16 in the clockwise direction as shown in FIG. 1, towards the upper guide roller 22. The fibrous web 38 as it moves away from the vacuum forming box 34, in one embodiment may comprise from about 19 percent to about 30 percent cellulosic fiber by weight. An edge vacuum 40 positioned below the forming belt 16 and proximate to the upper guide roller 22 assists in trimming the edges of the fibrous web 38.

The fibrous web 38 passes over the upper guide roller 22 and downwardly between the forming belt 16 and a throughdryer belt 42. The throughdryer belt 42 travels around a path defined by a series of guide rollers. The throughdryer belt 42 travels from a guide roller 44 positioned above and vertically offset from guide roller 22 downwardly towards the forming belt 16, contacts the fibrous web 38, and then downwardly and diagonally away from guide roller 24 to guide roller 46, passes under guide roller 46 and turns horizontally away from the forming belt 16 towards a throughdryer guide roller 48, passes under the throughdryer guide roller 48 and turns upwardly and over a throughdryer 50 and downwardly to a second throughdryer guide roller 55, passes under through guide roller 54 and turns upwardly to an upper guide roller 56 which it passes over and thereafter turns slightly downwardly to an upper guide roller 58, and turns slightly upwardly in the direction of the forming belt 16 to an upper guide roller 60, passes over upper guide roller 60 and turns downwardly to a guide roller 62, passes under guide roller 62 and turns substantially horizontally away from forming belt 16 to a guide roller 64, passes around guide roller 64 and turns horizontally in the direction of the forming belt 16 and returns to guide roller 44.

A vacuum pickup 66 pulls the fibrous web 38 towards the throughdryer belt 42 and away from forming belt 16 as the fibrous web passes between the throughdryer belt and the forming belt. The fibrous web 38 adheres to the throughdryer belt 42 and is carried by the throughdryer belt downwardly below the lower guide roller 46 towards the throughdryer 50. Vacuum boxes 68 positioned above and proximate to the throughdryer belt 42 between the lower guide roller 46 and the throughdryer guide roller 48 extract additional water from the moist fibrous web 38. The fibrous web 38 may preferably comprise between about 25 percent and 35 percent fiber by weight after passing beneath the vacuum boxes 68.

The TAD 50 generally comprises an outer rotatable perforated cylinder 51 and an outer hood 52. Hood 52 is used to direct a drying medium from the drying medium supply duct (not illustrated) and which is discharged against and through the fibrous web 38 and the throughdryer belt 42 as is known to those skilled in the art. The throughdryer belt 42 carries the fibrous web 38 over the upper portion of the throughdryer outer cylinder 51. A drying medium is forced through the fibrous web 38 and through the throughdryer belt 42 and through the perforations 53 in the outer cylinder 51 of the TAD 50. The drying medium removes the remaining water from the fibrous web 38 and exits the cylinder 51 along conduits (not illustrated) in proximity to outlets 57 positioned along the axis 59 of cylinder 51. The temperature of the drying medium forced through the fibrous web by the throughdryer is desirably about at least 300° F.

The throughdryer belt 42 carries the dried fibrous web 38 towards the lower guide roller 54. The dried web 38 is directed to a take-up roller 70 where the fibrous web is wound into a product roll 74.

Figure 2:
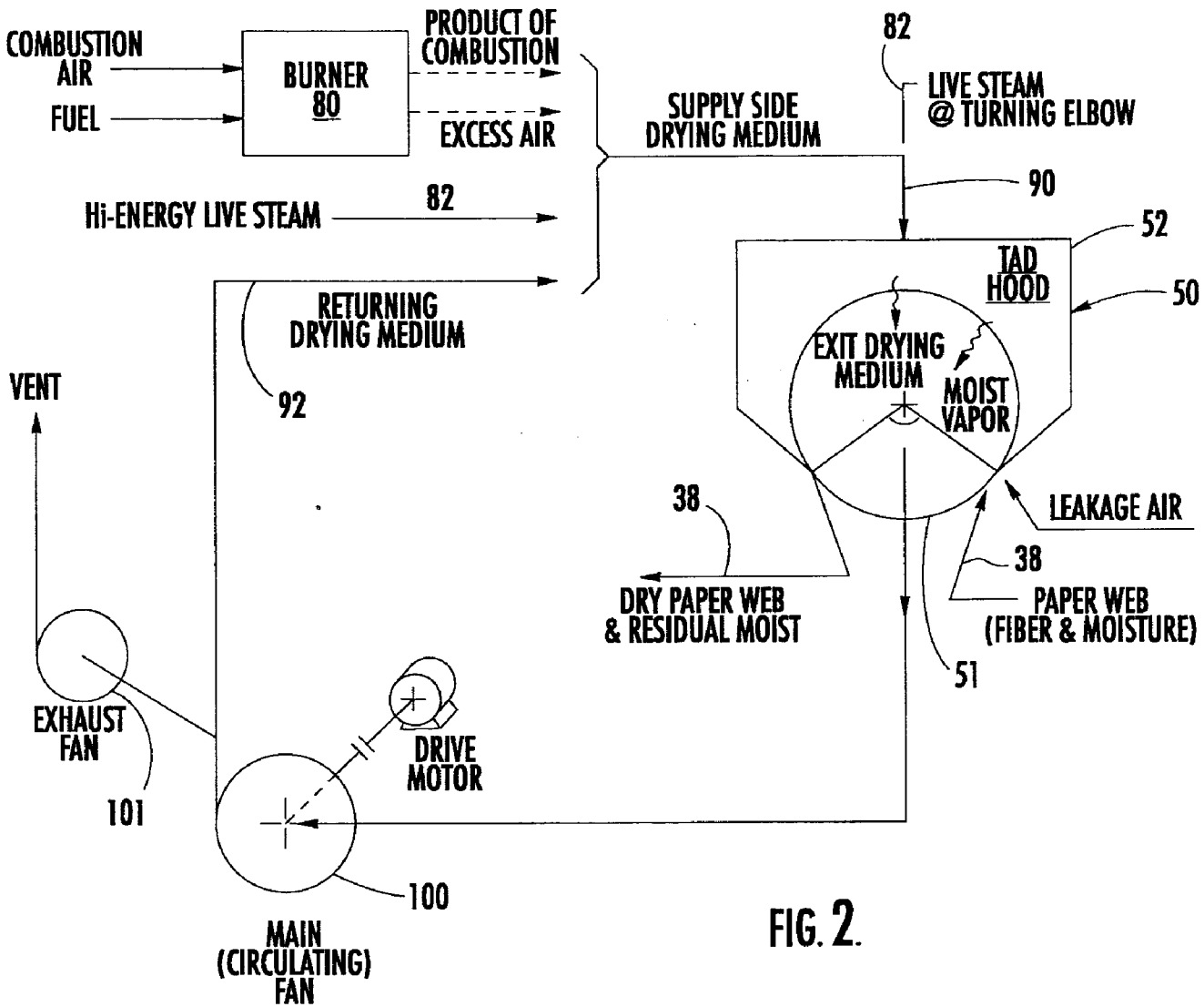
FIG. 2 is a schematic flow diagram of a TAD apparatus and drying process in which high energy steam is added as a component of the drying medium.

Turning to FIG. 2, there is illustrated a schematic representation of a throughair dryer and process for carrying out the present invention. The drying medium in this embodiment comprises a mixture of the combustion products from a fuel burner 80 and live high temperature pressurized steam 82. Burner 80 uses a fuel source, such as natural gas, which is burned in the presence of excess air. The resulting heated combustion products are further mixed with high energy live steam 82 and recycled drying medium 92 to provide a high temperature drying medium 90. Drying medium 90 may have a supply side temperature of between 300° F. to 600° F. when using 1000° F. live steam as a component of the drying medium 90. However, an even greater drying medium temperature is envisioned and may be obtained by increasing the relative amount and/or temperature of the introduced live steam. It is readily appreciated by one having ordinary skill in the art that the supply temperature of released steam may be greater or lesser than the 1000° F. live steam example set forth above. Such variations in steam temperature do not alter the ability to use the varying temperature steam so as to bring about the improvements of the present invention.

The drying medium 90 is introduced to the TAD 50 within the interior enclosure defined by hood 52. The velocity of the drying medium 90 directs the drying medium to contact the outer supply side of moving web 38, passing the drying medium through web 38 as the medium 90 continues through the throughbelt 42, and into the interior cylinder 51 before exiting through outlets 57, as seen in reference to FIG. 1.

As the drying medium 90 passes through web 38, the drying medium 90 raises the temperature of web 38, thereby converting the water content of the web to steam. The steam is released from the web fibers/matrix and passes into the drying medium. The circulating fan 100 is used to circulate the drying medium as it exits the web 38. The used drying medium 92 is then recirculated in part to the feed stream of the drying medium along with additional live steam.

The returning or used dryer medium 92, upon exiting the web 38, will experience a temperature drop upon entry into the interior of the cylinder 51. Further, ambient air is typically entrained into the recirculating loop pathway of mediums 90 and 92 by air leakage along gap regions of the hood baffle 61 associated with the passage of web 38 into and out of TAD 50. To maintain a proper balance of the dryer medium constituents 90, a portion of the used dryer medium 92 may be vented using exhaust fans 101 to maintain a desired balance of the heated combustion products, including combustion air, high energy steam, and the recycled used dryer medium 92. The latter component may include ambient air entrained by movement of the web relative to the dryer.

Figure 3:
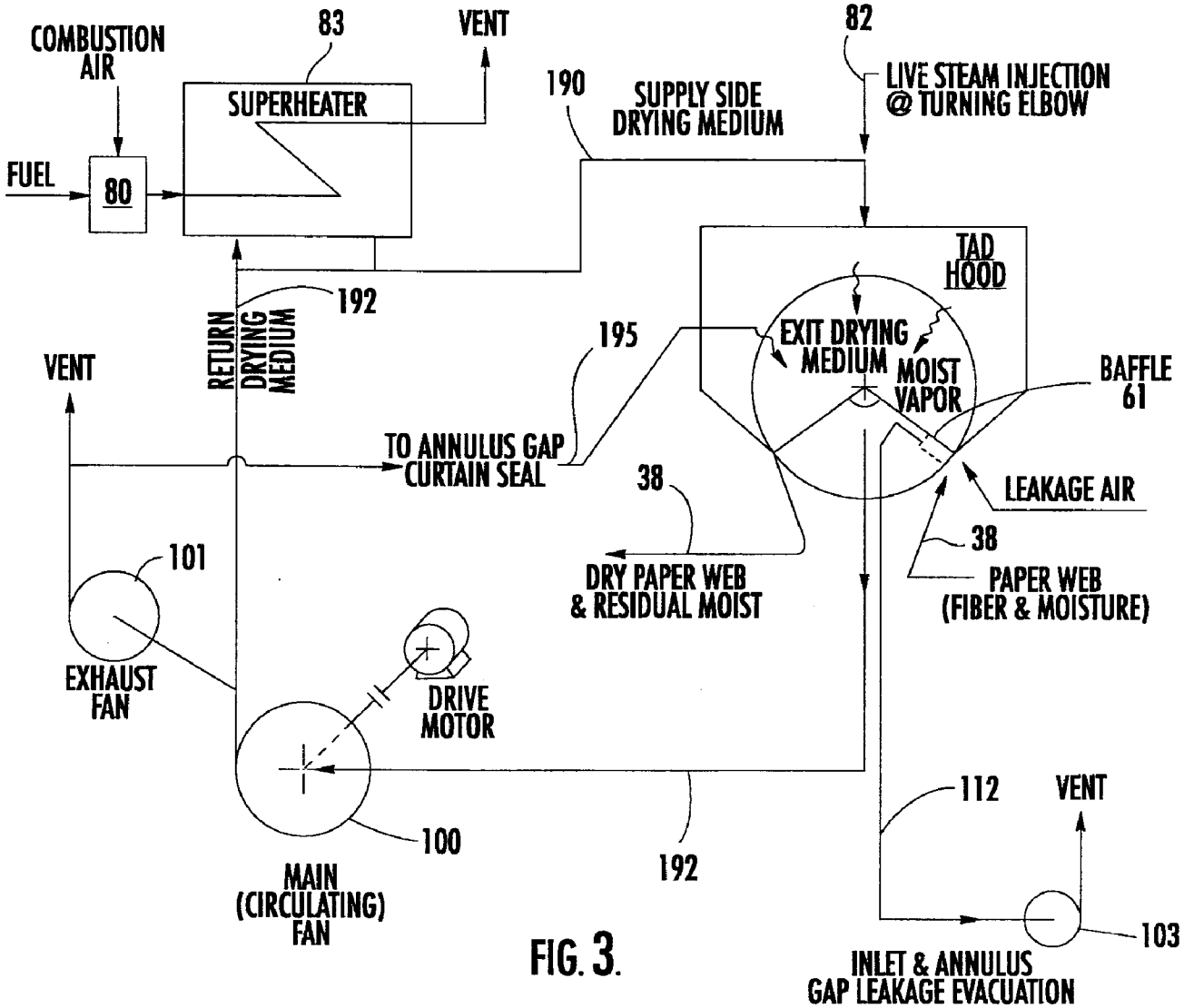
FIG. 3 is a schematic flow diagram of a TAD apparatus and process for the substantially oxygen-free drying of a tissue web.

Referring now to FIG. 3, an additional embodiment of the present invention is set forth in which a substantially oxygen-free drying medium 190 is used with the TAD 50. In this embodiment, the burner 80 is operatively engaged with a heat exchanger 83. Heat exchanger 83 is used to transfer the thermal energy from the combustion products of burner 80 to the return drying medium 192. The actual combustion products, however, are vented from the system and do not form part of the actual drying medium 190.

The return drying medium 192, upon passage through heat exchanger 83, is further mixed with live steam. The resulting heated mixture comprises the supply side drying medium 190.

Figure 5:
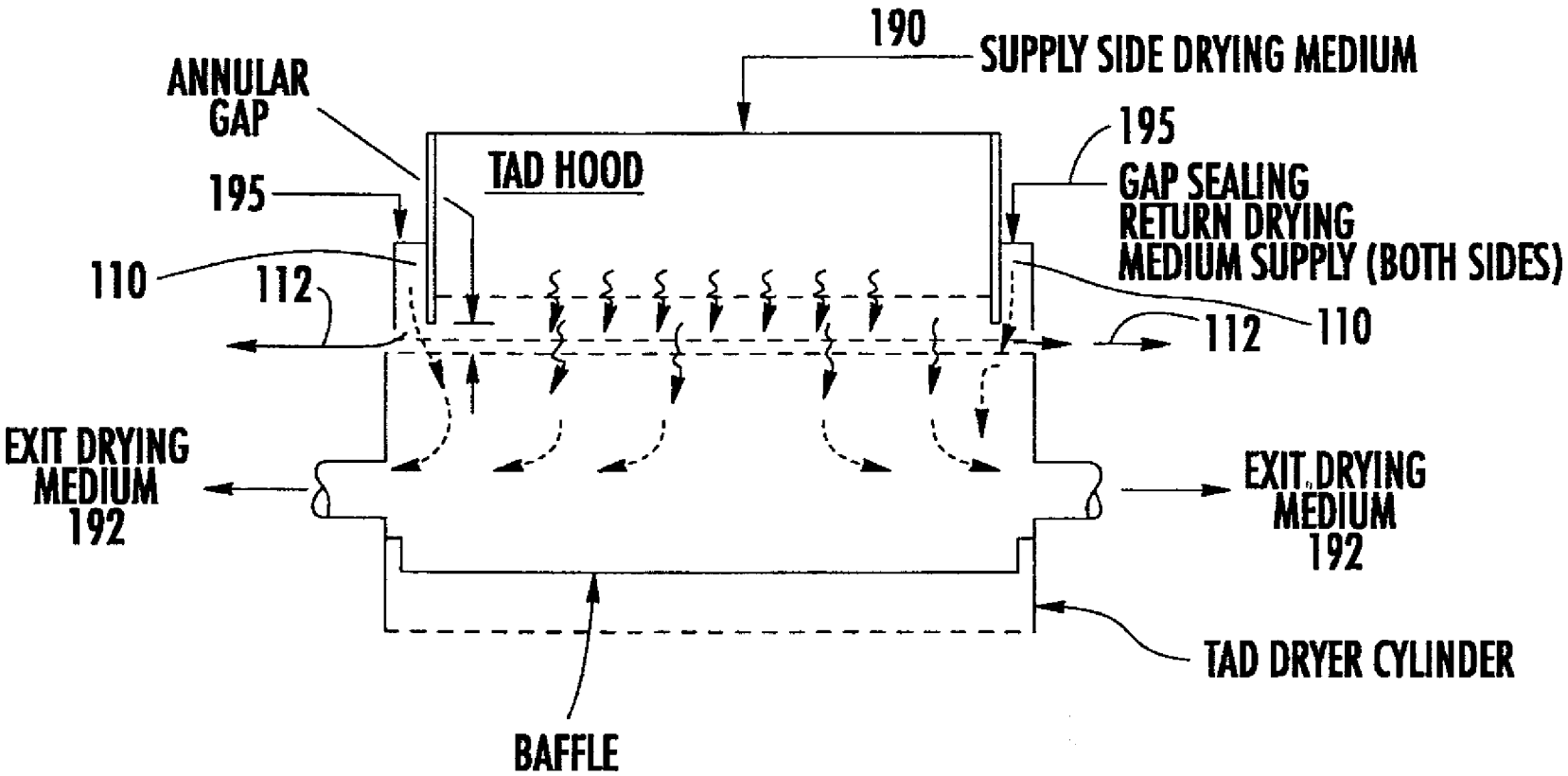
FIG. 5 is a schematic view setting forth details of the gap sealing feature of the present invention using a portion of the discharged dryer medium exhaust to prevent the entrainment of ambient air into the drying medium loop.

As further set forth in reference to FIGS. 3 and 5, a portion of the cooled exiting drying medium 192 may be diverted to form an air curtain along the air entrainment locations associated with the throughair dryer. A portion 195 of the exiting drying medium is discharged along an outlet adjacent the baffle and air gaps 110 defined between the throughair hood 52 and the web 38. A partial vacuum pathway 112 may be used to establish a sustained flow path of the resulting air curtain. The air curtain precludes entry of ambient air into the throughair dryer and therefore excludes the ambient air from entry into the drying medium pathway. As seen in FIG. 3, the used drying medium 112 associated with the air curtain is thereafter vented as an exhaust product by a blower 103. Additional portions of the used dryer medium 192 is vented by exhaust fan 101 as needed to accommodate the introduction of new quantities of live steam to reestablish the high temperature steam profile of drying medium 190.

The pressurized release of live steam into the drying medium accomplishes several objectives. First, the steam increases the temperature of the drying medium and allows a supply side temperature of the drying medium to exceed the drying temperatures of a conventional dry air TAD. Second, the release of pressurized live steam into the drying medium pathway increases the velocity of the drying medium. As a consequence, the energy demands and capacity of electric fans or blowers associated with the drying medium circulation loop may be reduced. Third, the use of a high steam content drying medium also improves certain desirable qualities of the resulting throughair dried web. For instance, the absorbency and softness of a tissue TAD product, may be improved by raising the tissue to a temperature greater than the glass transition temperature of the cellulosic fibers. The steam content of the drying medium lowers the glass transition point of the cellulosic fibers. Further, the steam allows a higher drying temperature to be achieved. The combination of a lower glass transition temperature and higher drying temperature allows an improved product molding to occur. The molding process, as known in the art, provides a three-dimensional texture to the resulting web which is desirable for certain tissue products. The resulting molded shape is softer, more absorbent, and allows the tissue product to maintain its textured shape when exposed to moisture.

Figure 4:
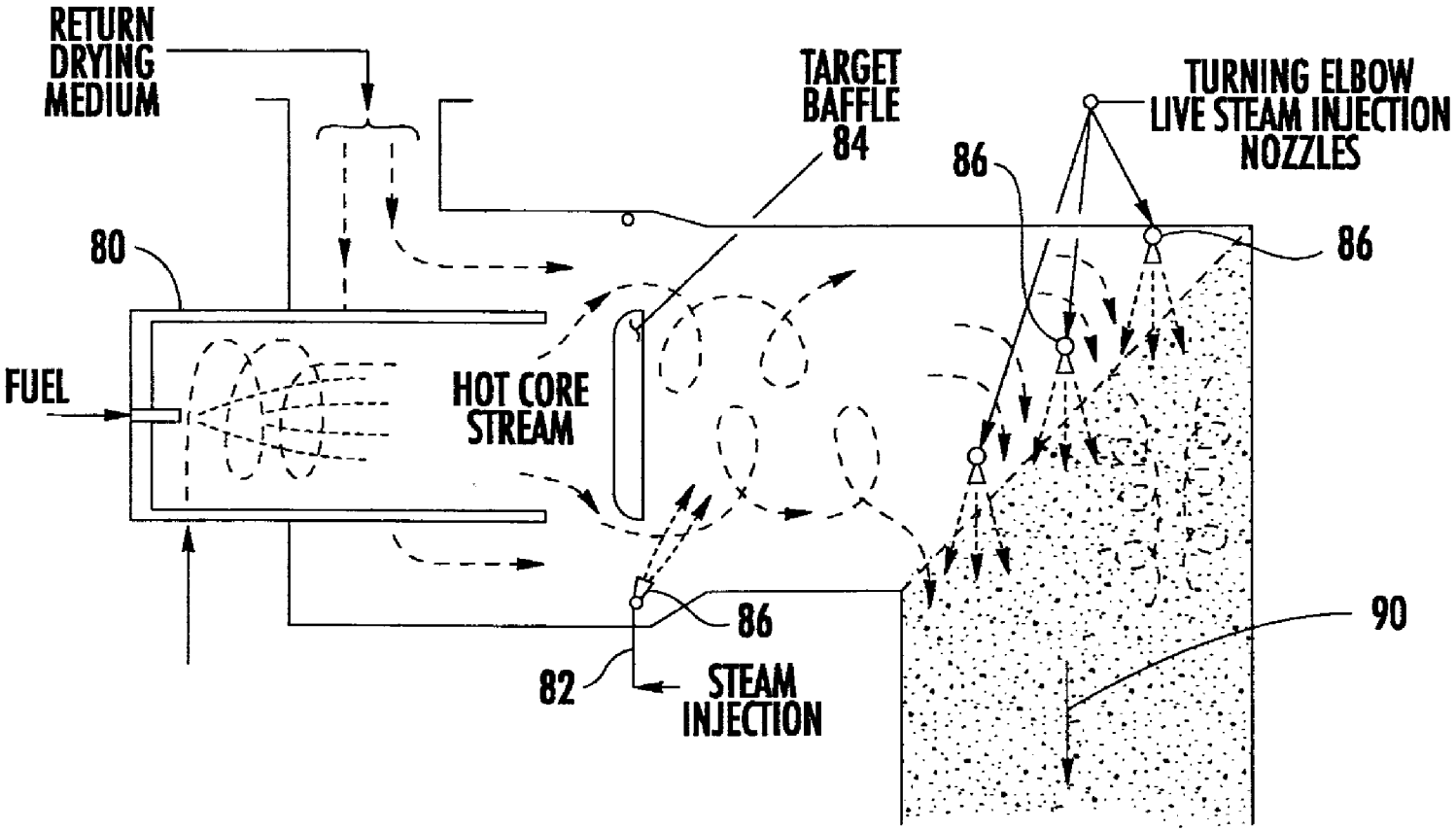
FIG. 4 is a schematic view setting forth details of a steam injection apparatus and process for a TAD.

In reference now to FIG. 4, details of one example of the addition of a live steam component to a TAD medium is set forth. In the illustrated embodiment of FIG. 4, burner 80 releases an initial stream of heated combustion products. The heated combustion products are then intermixed with a fan-driven return drying medium 92 along with live steam 82. A system of one or more baffles 84 may be placed within the respective flow paths to achieve an improved intermixing of the component fractions of the drying medium. Additional injection nozzles 86 may be provided so that live steam is injected along additional locations of the enclosed flow path of the drying medium loop. As illustrated, steam injection along turning elbows of the flow path ductwork are believed particularly useful. Such regions are associated with high turbulence and provide an opportunity to intermix the newly injected live steam with the other components of the drying medium.

As set forth above, it has been found that live steam may be added to an existing throughair dryer apparatus and process to bring about the stated improvements. It is readily appreciated by one having ordinary skill in the art that as the relative amount of live steam introduced into the drying medium is increased, the relative percentage of drying medium atmospheric oxygen is decreased. Accordingly, as the live steam content of the drying medium is increased, the temperature of the drying medium which may be used without scorching or burning the tissue web also increases. The drying medium may have a free oxygen concentration of less than the ambient oxygen concentration of air of 21%. Optimally, the drying medium has a free oxygen concentration of less than 15% and desirably, less than 10%. It is yet still more desirable to provide a drying medium which is substantially free of atmospheric oxygen.

With respect to an existing TAD apparatus and process, live steam may be added as a component of the existing drying medium. The introduction of live steam is believed useful in that the energy demands placed upon the electric fans and blowers used to circulate the drying medium will be reduced. The pressurized release of live steam contributes to the displacement and velocity of the drying medium. Further, the increased temperature of the drying medium permits a more efficient drying of the associated web. As such, the improved efficiency may permit a more rapid throughput of the web through the throughair dryer process or allow a reduction in the drying medium volume and/or flow rate, either of which would also contribute to overall cost savings of operation.

It is also possible to provide a throughair dryer and process in which the TAD uses a drying medium of substantially 100 percent live steam. As such, the throughair drying medium is substantially free of atmospheric oxygen which allows the web to be raised to much greater temperatures which, heretofore, would have resulted in a scorching or burning of the fabric web.

In certain embodiments of this invention, it is envisioned that the requirement of motorized blowers and fans may be substantially reduced in terms of size and capacity or eliminated altogether from the system. In their place, the circulation pathway of the drying medium loop can be established and maintained through the pressurized release of steam.

In one embodiment of the present invention, an apparatus and process of oxygen-free drying is disclosed. While this embodiment discloses the use of substantially 100 percent steam as the drying medium, it is possible that other inert gases could be used in combination with the live steam. Such a use is envisioned within the scope of applicants' substantially oxygen-free drying process.

Although various embodiments of the invention have been described using specific terms, devices, and methods, such description is for illustrative purposes only. The words used are words of description rather than of limitation. It is to be understood that changes and variations may be made by those of ordinary skill in the art without departing from the spirit or scope of the present invention, which is set forth in the following claims. In addition, it should be understood that aspects of the various embodiments may be interchanged, both in whole or in part. Therefore, the spirit and scope of the appended claims should not be limited to the description of the preferred versions contained therein.

That which is claimed is:

1. A process of drying a fibrous wet web comprising the steps of:

supplying a moving fibrous wet web;

supplying a first drying medium having a first free oxygen concentration;

reducing the free oxygen concentration within the first medium by the introduction of a heated substantially oxygen-free fluid into the first drying medium, thereby providing a second drying medium having a second free oxygen concentration less than the first free oxygen concentration, the second drying medium having a free oxygen concentration less of less than 21%; and passing the second drying medium through the fibrous wet web and thereby drying the web.

2. The process according to claim 1, wherein the heated substantially oxygen-free fluid is pressurized steam.

3. The process according to claim 2, wherein the pressurized steam comprises about 10 to about 15 percent by volume of the drying medium passed through the fibrous wet web.

4. The process according to claim 1, wherein the heated substantially oxygen-free fluid has a supply temperature greater than a temperature of the first drying medium.

5. The process according to claim 1, wherein a temperature of the drying medium having the heated substantially oxygen-free fluid is at least about 500° F.

6. A process of drying a wet cellulosic web comprising:

supplying a moving fibrous web of wet cellulose fibers;

supplying a first drying medium having a first free oxygen concentration;

reducing the free oxygen concentration within the first medium by the introduction of a heated substantially oxygen-free fluid into the first drying medium, thereby providing a second drying medium having a second free oxygen concentration less than the first free oxygen concentration, the second drying medium having a free oxygen concentration of less than 21%; and passing the second drying medium through the wet cellulosic web and thereby drying the web.

7. The process according to claim 6 wherein said second drying medium has a free oxygen concentration of less than 15%.

8. The process according to claim 7 wherein the heated substantially oxygen-free fluid is pressurized steam.

9. The process according to claim 7 wherein the heated substantially oxygen-free fluid has a supply temperature greater than the temperature of the first drying medium.

10. The process according to claim 7 wherein the second drying medium temperature is greater than the scorch temperature of a cellulosic web.

11. A process of throughair drying a tissue web comprising:

supplying a moving fibrous web of cellulose fibers and water;

supplying a first drying medium comprising heated air;

releasing into the first drying medium pressurized steam having an oxygen concentration less than ambient air, thereby providing a second drying medium, the pressurized steam raising the temperature of the second drying medium to a temperature greater than the temperature of the first drying medium; and passing the second drying medium through the moving fibrous web, thereby changing the water within the fibrous web to a water vapor, the water vapor removed from the fibrous web and released into the second drying medium and thereby providing a dry web.

12. The process according to claim 11 wherein the second drying medium comprises substantially about at least 10 percent by volume of pressurized steam.

13. The process according to claim 11 wherein the second drying medium comprises from about 10 percent to about 21 percent by volume of a pressurized steam.

14. The process according to claim 11 wherein the second drying medium has a temperature of at least about 500° F.

15. The process according to claim 11 comprising the additional step of:

providing an air curtain directed along the air entrainment gaps of the moving fibrous web, the air curtain provided by a directed discharge of the second drying medium containing the water vapor removed from the web.

* * * * *